US009095014B2

(12) United States Patent
Chen

(10) Patent No.: US 9,095,014 B2
(45) Date of Patent: Jul. 28, 2015

(54) LED LIGHT STRING AND CONTROL METHOD THEREOF

(75) Inventor: Jerry Chen, Guang Zhou (CN)

(73) Assignee: WELLSINO ELECTRIC CO., LTD, Guang Zhou, Guang Dong Province (CN)

( * ) Notice: Subject to any disclaimer, the term of this patent is extended or adjusted under 35 U.S.C. 154(b) by 647 days.

(21) Appl. No.: 13/491,225

(22) Filed: Jun. 7, 2012

(65) Prior Publication Data

US 2013/0328490 A1 Dec. 12, 2013

(51) Int. Cl.
*H05B 37/02* (2006.01)

(52) U.S. Cl.
CPC ..... *H05B 37/0263* (2013.01); *H05B 37/0272* (2013.01)

(58) Field of Classification Search
CPC ..... H05B 37/0272; H05B 37/0263
See application file for complete search history.

(56) References Cited

U.S. PATENT DOCUMENTS 5,905,442 A * 5/1999 Mosebrook et al. ..... 340/3.7
6,046,550 A * 4/2000 Ference et al. ..... 315/291
6,424,096 B1 * 7/2002 Lowe et al. ..... 315/185 R
6,636,005 B2 * 10/2003 Wacyk et al. ..... 315/291
8,421,371 B2 * 4/2013 Shimizu et al. ..... 315/291
2007/0081346 A1 * 4/2007 Spinello ..... 362/394
2009/0206983 A1 * 8/2009 Knode et al. ..... 340/3.7
2011/0309769 A1 * 12/2011 Kuroki et al. ..... 315/294
2013/0181630 A1 * 7/2013 Taipale et al. ..... 315/224
2014/0152181 A1 * 6/2014 Burkhart ..... 315/122
2014/0265897 A1 * 9/2014 Taipale et al. ..... 315/200 R
2014/0320030 A1 * 10/2014 Chiang ..... 315/185 R
2014/0361623 A1 * 12/2014 Siessegger et al. ..... 307/64

* cited by examiner

*Primary Examiner* — Thomas J Hiltunen
(74) *Attorney, Agent, or Firm* — Muncy, Geissler, Olds & Lowe, P.C.

(57) ABSTRACT

A LED light string contains an adjustable remote control and a control host connected with the LED light string, wherein the adjustable remote control includes a button set, a subhost MCU, and a TX transmitter module, the sub host includes a TX coding module, and a variation of a pressed time and/or a pressing way of the button set generates a press signal received and coded by the TX coding module; the control host includes a RX receiver module and a host MCU; the host MCU includes an AC 60 HZ/50 HZ synchronization over-zero module, a RF decoding analysis module, and a two-way controllable silicon driving circuit module, thus controlling a light flash of the LED light string.

10 Claims, 4 Drawing Sheets

LED LIGHT STRING AND CONTROL METHOD THEREOF

BACKGROUND OF THE INVENTION

1. Field of the Invention

The present invention relates to a LED light, and more particularly to a LED light string and a control method thereof which is capable of controlling and adjusting different light flashes.

2. Description of the Prior Art

LED light has an energy saving advantage and an environmental protection advantage and is applied to indication lights, traffic lights, displays, car lights, and micro-flashlights to flash different lights.

Accordingly, developing LED light string to control and shift different light flashes is an important concern.

The present invention has arisen to mitigate and/or obviate the afore-described disadvantages.

SUMMARY OF THE INVENTION

The primary object of the present invention is to provide a LED light string and a control method thereof which is capable of controlling and adjusting different light flashes.

Another object of the present invention is to provide a LED light string and a control method thereof which is capable of controlling and adjusting different light flashes easily.

A LED light string provided by the present invention contains:

an adjustable remote control and a control host connected with the LED light string, characterized in that:

the adjustable remote control includes a button set, a sub-host MCU, and a TX transmitter module, the sub host includes a TX coding module for saving predetermined transmitting codes, and a variation of a pressed time and/or a pressing way of the button set generates a press signal received and coded by the TX coding module, and then a control signal is transmitted to the control host by the TX transmitter module to correspond to the press signal;

the control host includes a RX receiver module and a host MCU connected with the RX receiver module, the RX receiver module receives the control signal transmitted by the TX transmitter module and then transmits the control signal to the host MCU;

the host MCU includes an AC 60 HZ/50 HZ synchronization over-zero module, a RF decoding analysis module, and a two-way controllable silicon driving circuit module;

the AC 60 HZ/50 HZ synchronization over-zero module is used to acquire a 60 HZ/50 HZ signal in an alternating current to control a conductive phase angle of a silicon controlled rectifier such that the LED light string flashes in a light on-off and increasing-decreasing manner;

the RF decoding analysis module analyzes different control signals and outputs a flash signal corresponding to the different control signals to drive the silicon controlled rectifier;

the two-way controllable silicon driving circuit module connects with the LED light string and changes a conductive phase angle of a two-way silicon controlled rectifier by using a software coding method and a conduction current and changes a phase angle of a positive half-cycle and a negative half-cycle of the LED light string, thus controlling a light flash of the LED light string.

A control method of the LED light string provided by the present invention contains steps of:

S100 including receiving a button signal from a control button by using a TX coding module of an adjustable remote control, transmitting a control signal to a control host after the control signal is coed;

S200 including controlling a RX receiver module of the adjustable remote control to receive the control signal transmitted and then transmitting the control signal to the host MCU;

S300 including acquiring a 60 HZ/50 HZ signal in an alternating current by using an AC 60 HZ/50 HZ synchronization over-zero module of a host MCU to control a conductive phase angle of a silicon controlled rectifier; analyzing the control signal by ways of a RF decoding analysis module and outputting a flash signal to drive the silicon controlled rectifier; connecting a two-way controllable silicon driving circuit module with the LED light string, and changing a conductive phase angle of the two-way silicon controlled rectifier by using a software coding method and a conduction current and changing a phase angle of a positive half-cycle and a negative half-cycle of the LED light string, thus controlling a light flash of the LED light string;

S400 changing a pressed time of the control button so that the control signal is transmitted to the control host by the TX transmitter module to correspond to a press signal, wherein the control button is pressed one time to correspond to the control signal, and the control button is pressed twice to correspond to the control signal, and so no. The RF decoding analysis module analyzes different control signals and outputs a flash signal corresponding to the different control signals to drive the silicon controlled rectifier, thus controlling and shifting a light flash of the LED light string.

DETAILED DESCRIPTION OF THE PREFERRED EMBODIMENTS

Figure 1:
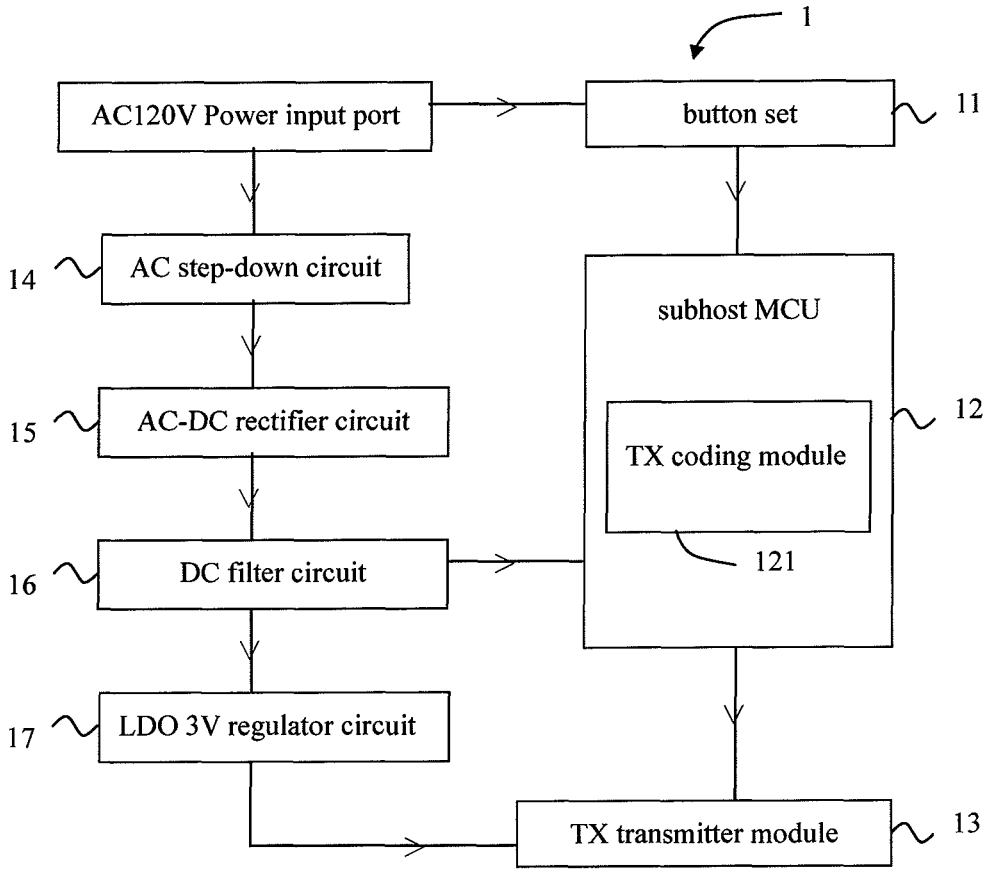
FIG. 1 is a diagram of an adjustable remote control of a LED light string according to the present invention.
Figure 2:
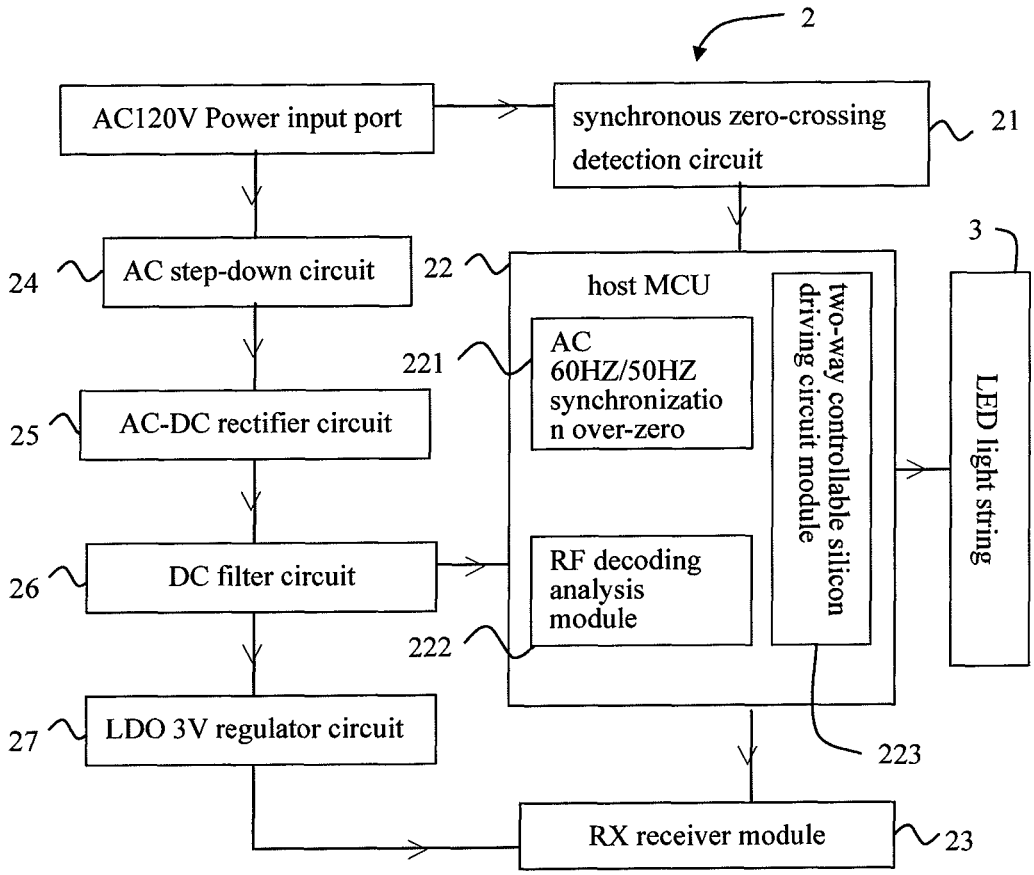
FIG. 2 is a diagram of a control host of a LED light string according to the present invention.
Figure 3:
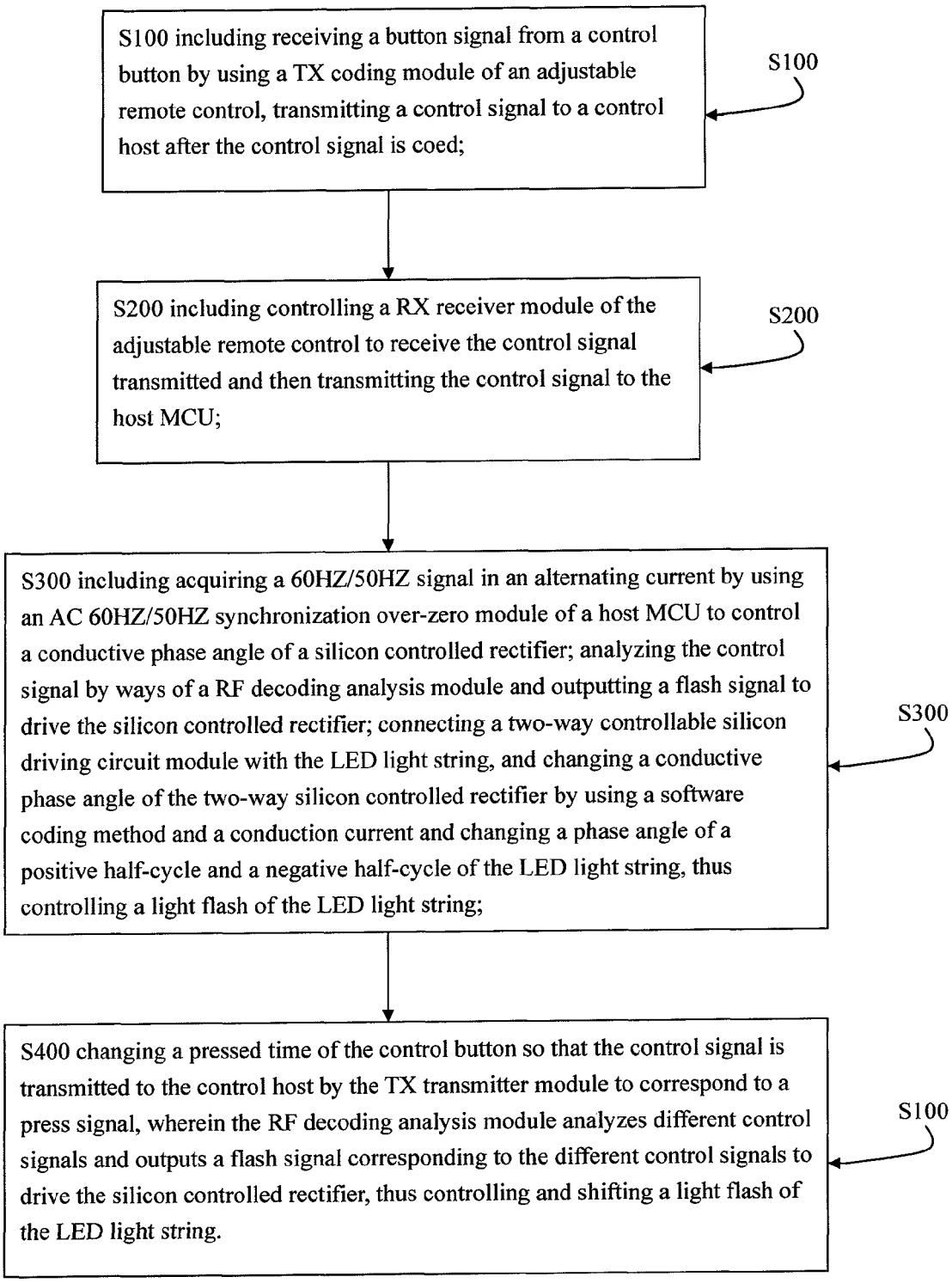
FIG. 3 is a flow chart showing the control steps of the LED light string according to the present invention.

Referring to FIGS. 1 and 2, a LED light string according to the present invention comprises an adjustable remote control 1 and a control host 2 connected with the LED light string 3. The adjustable remote control 1 includes a button set 11, a subhost MCU12, and a TX transmitter module 13. The sub host 12 includes a TX coding module 121 for saving predetermined transmitting codes, and a variation of a pressed time and/or a pressing way of the button set generates a press signal received and coded by the TX coding module 121, and then a control signal is transmitted to the control host 2 by the TX transmitter module 13 to correspond to the press signal. The control host 2 includes a RX receiver module 23 and a host MCU22 connected with the RX receiver module 23, the RX receiver module 23 receives the control signal transmitted by the TX transmitter module 13 and then transmits the control signal to the host MCU22. The host MCU22 includes an AC 60 HZ/50 HZ synchronization over-zero module 221, a RF decoding analysis module 222, and a two-way controllable silicon driving circuit module 223. The AC 60 HZ/50 HZ synchronization over-zero module 221 is used to acquire a 60 HZ/50 HZ signal in an alternating current to control a conductive phase angle of a silicon controlled rectifier such that the LED light string 3 flashes in a light on-off and increasing-decreasing manner. The RF decoding analysis module 222 analyzes different control signals and outputs a flash signal corresponding to the different control signals to drive the silicon controlled rectifier. The two-way controllable silicon driving circuit module 223 connects with the LED light string 3 and changes a conductive phase angle of a two-way silicon controlled rectifier by using a software coding method and a conduction current and changes a phase angle of a positive half-cycle and a negative half-cycle of the LED light string, thus controlling a light flash of the LED light string. The LED light string of the present invention is shifted between a positive phase and a negative phase. The RF decoding analysis module 222 analyzes the control signal and outputs the flash signal to drive the silicon controlled rectifier so as to control a light flash of the LED string, such that the LED light string is capable of controlling and shifting different light flashes by changing the pressed time and the pressing way.

The variation of the pressed time of the button set generates different button signals, and the control signal is outputted based on the different button signals to generate the flash signal, thus changing light flashes. The different pressed times, for instance, from one time to seven times, the light flashes are shifted and looped. Furthermore, when providing different numbers of buttons, each corresponding to a control of different light flashes, the different light flashes are controlled and shifted.

It is to be noted that the adjustable remote control 1 and the control host 2 are connected in a wired connection manner or a wireless connection manner. Preferably, the adjustable remote control 1 transmits the control signal to the control host 2 in the wireless connection manner, thereby obtaining a flexible control. When the adjustable remote control 1 is connected in the wireless connection manner, a carrier frequency point is 433 MHz, and the transmitter module 13 contains a TX transmitting circuit (not shown) connected with a transmitting antenna (not shown).

To achieve a more stable performance of the LED light string of the present invention, the adjustable remote control 1 and/or the control host 2 include a step-down circuit, a rectifier circuit, a filter circuit, and a regulator circuit. Because such an arrangement is well-known in the related field, further remarks are omitted. Preferably, the step-down circuit includes two AC step-down circuits 14, 24, the rectifier circuit includes two AC-DC rectifier circuits 15, 25, the filter circuit includes two filter circuits 16, 26, and the regulator circuit includes two LDO 3V regulator circuits 17, 27. Preferably, the control host 2 includes a synchronous zero-crossing detection circuit 21 to detect a zero-crossing signal so as to control a clock synchronization, and after shifting different flash modes in 3 seconds, a synchronous process starts.

The LED light string 3 includes the at least two LED light sets, and a number of the at least two LED light sets is increased based on an actual requirement. The LED light string 3 includes six LED light sets in which there are three A-color LED light sets, and the other three LED light sets are a B color. Because the six LED light sets are a A color and the B color, the LED light string is comprised of an even number of LED lights to coordinate a flashing effect.

The button set includes a control button and a switch (not shown), the control button is severed to realize six light flashes on the basis of different pressed times. As adjusting the light flashes, the RF decoding analysis module 222 analyzes the control signal transmitted from the adjustable remote control 1, and the control host 2 starts the two-way controllable silicon driving circuit module 223 as receiving a start signal transmitted by the adjustable remote control 1 (as pressing the control button at first time), and then the control host 2 starts the two-way controllable silicon driving circuit module 223 to start the LED light string 3, thereafter as receiving six modes of optional lights (to choose the light flash based on the pressed time), the control host 2 outputs the flash signal to drive the two-way controllable silicon driving circuit module 223. As receiving a power-off signal transmitted by the adjustable remote control 1, the control host 2 turns off the two-way controllable silicon driving circuit module 223 and enters a standby state.

In this embodiment, the LED light string includes the six LED light sets, and each set has A-color LED lights and B-color LED lights, the operation of the LED light string of the present invention is described as follows:

as pressing the control button at first time: the LED light string is turned on in a first mode, i.e., starting the A-color LED lights;

as pressing the control button at second time: the LED light string is turned on in a second mode, i.e., starting the B-color LED lights;

as pressing the control button at third time: the LED light string is turned on in a third mode, i.e., the A-color LED lights flash to correspond to the B-color LED lights which flash;

as pressing the control button at fifth time: the LED light string is turned on in a fourth mode, i.e., the A-color LED lights illuminate in six automatic cycle modes including a first small mode: the A-color LED lights illuminate; a second small mode: the A-color LED lights illuminate in a wave type; a third small mode: the A-color LED lights illuminate in a water drop type; a fourth small mode: the A-color LED lights and the B-color LED lights illuminate in a step-by-step changing type, for instance, when the A-color LED lights illuminate in a bright-to-dim type, the B-color LED lights illuminate in a dim-to-bright type or when the B-color LED lights illuminate in the bright-to-dim type, the A-color LED lights illuminate in the dim-to-bright type; a fifth small mode: the A-color LED lights illuminate to one direction in the wave type, and then the A-color LED lights and the B-color LED lights respectively flash in turn, thereafter the A-color LED lights illuminate to an opposite direction in the wave type, finally the A-color LED lights and the B-color LED lights respectively flash in turn in the opposite direction; a sixth small mode: the A-color LED lights become dim gradually and then become bright gradually; a seventh small mode: A-color LED lights flash in turn;

as pressing the control button at fifth time: the LED light string is turned on in a fifth mode, i.e., the B-color LED lights illuminate in six automatic cycle modes including a first small mode: the B-color LED lights illuminate; a second small mode: the B-color LED lights illuminate in a wave type; a third small mode: the B-color LED lights illuminate in the water drop type; a fourth small mode: the B-color LED lights and the B-color LED lights illuminate in a step-by-step changing type, for instance, when the B-color LED lights illuminate in a bright-to-dim type, the B-color LED lights illuminate in a dim-to-bright type or when the B-color LED lights illuminate in the bright-to-dim type, the B-color LED lights illuminate in the dim-to-bright type; a fifth small mode: the B-color LED lights illuminate to one direction in the wave type, and then the B-color LED lights and the A-color LED lights respectively flash in turn, thereafter the B-color LED lights illuminate to an opposite direction in the wave type, finally the B-color LED lights and the A-color LED lights respectively flash in turn in the opposite direction; a sixth small mode: the B-color LED lights become dim gradually and then become bright gradually; a seventh small mode: B-color LED lights flash in turn;

as pressing the control button at sixth time: LED light string illuminates in the sixth small mode and automatically cycles from the first small mode to the fifth small mode;

as pressing the control button at seventh time: the LED light string illuminates in the first small mode. i.e., the six LED light sets illuminate circularly. Besides, pressing the control button at the first time means pressing the switch and then pressing the control button.

Figure 4:
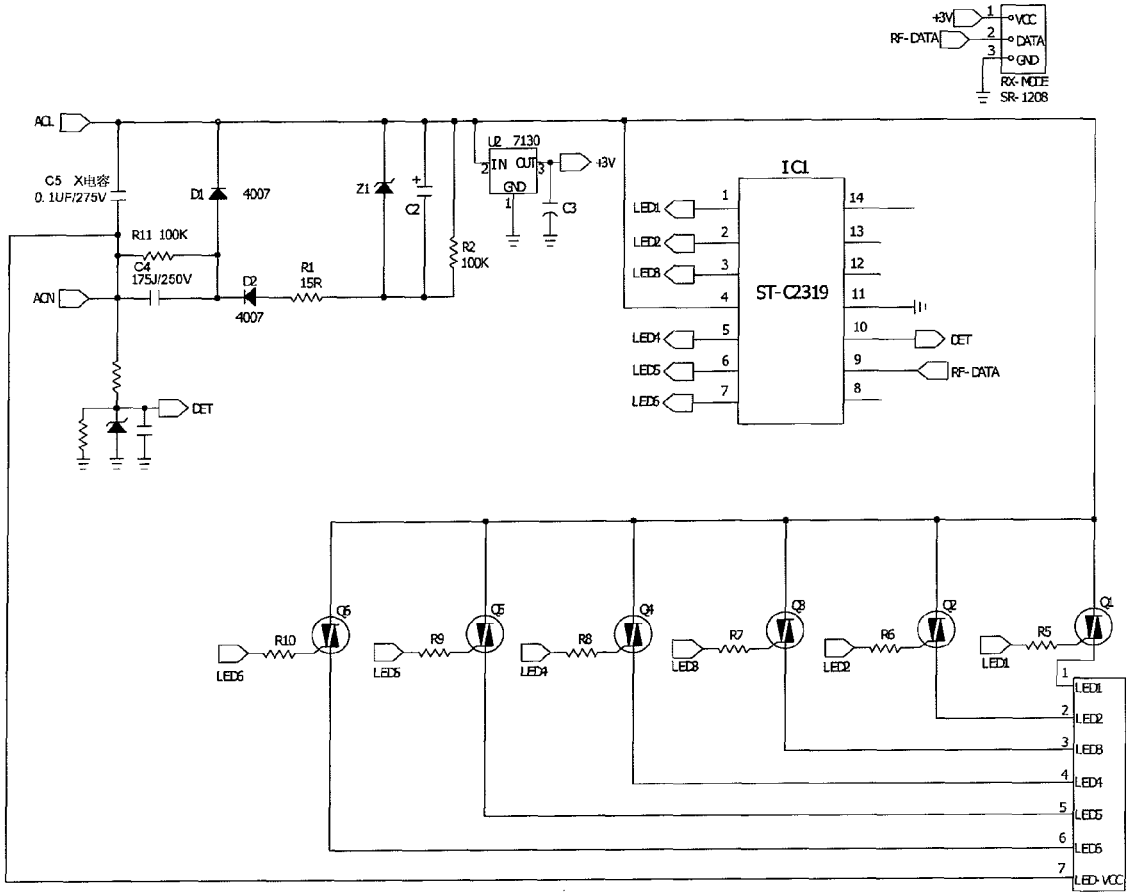
FIG. 4 is a circuit diagram showing the operation of the LED light string according to the present invention.

FIG. 4 is a circuit diagram showing the operation of the LED light string according to the present invention, wherein D1, D2 are a rectifier diode, U2 is a chip regulator IC (HT7130 SOT-89), Z1 is a chip/pin zener diode, IC1 is a chip IC, Q1, Q2, Q3, Q4, Q5, and Q6 are a two-way silicon controlled rectifier, R1 is a pin carbon film/metal film resistors, C2 is a pin electrolytic capacitor, SR-1208 is a receiver module, a fourth resistor C4 utilizes 175 J/250V, and a fifth resistor C5 utilizes 0.1 UF/275V.

A control method of the LED light string of the present invention comprises steps of:

S100 including receiving a button signal from a control button 11 by using a TX coding module 121 of an adjustable remote control 1, transmitting a control signal to a control host 2 after the control signal is coed;

S200 including controlling a RX receiver module 23 of the adjustable remote control 1 to receive the control signal transmitted and then transmitting the control signal to the host MCU 22;

S300 including acquiring a 60 HZ/50 HZ signal in an alternating current by using an AC 60 HZ/50 HZ synchronization over-zero module 221 of a host MCU22 to control a conductive phase angle of a silicon controlled rectifier; analyzing the control signal by ways of a RF decoding analysis module 222 and outputting a flash signal to drive the silicon controlled rectifier; connecting a two-way controllable silicon driving circuit module 223 with the LED light string 3, and changing a conductive phase angle of the two-way silicon controlled rectifier by using a software coding method and a conduction current and changing a phase angle of a positive half-cycle and a negative half-cycle of the LED light string, thus controlling a light flash of the LED light string;

S400 changing a pressed time of the control button so that the control signal is transmitted to the control host by the TX transmitter module to correspond to a press signal, wherein the control button is pressed one time to correspond to the control signal, and the control button is pressed twice to correspond to the control signal, and so no. The RF decoding analysis module analyzes different control signals and outputs a flash signal corresponding to the different control signals to drive the silicon controlled rectifier, thus controlling and shifting a light flash of the LED light string.

In this embodiment, the operating of the control method of the LED light string of the present invention is described as follows:

as pressing the control button at first time: the LED light string is turned on in a first mode, i.e., starting the A-color LED lights;

as pressing the control button at second time: the LED light string is turned on in a second mode, i.e., starting the B-color LED lights;

as pressing the control button at third time: the LED light string is turned on in a third mode, i.e., the A-color LED lights flash to correspond to the B-color LED lights which flash;

as pressing the control button at fifth time: the LED light string is turned on in a fourth mode, i.e., the A-color LED lights illuminate in six automatic cycle modes including a first small mode: the A-color LED lights illuminate; a second small mode: the A-color LED lights illuminate in a wave type; a third small mode: the A-color LED lights illuminate in a water drop type; a fourth small mode: the A-color LED lights and the B-color LED lights illuminate in a step-by-step changing type, for instance, when the A-color LED lights illuminate in a bright-to-dim type, the B-color LED lights illuminate in a dim-to-bright type or when the B-color LED lights illuminate in the bright-to-dim type, the A-color LED lights illuminate in the dim-to-bright type; a fifth small mode: the A-color LED lights illuminate to one direction in the wave type, and then the A-color LED lights and the B-color LED lights respectively flash in turn, thereafter the A-color LED lights illuminate to an opposite direction in the wave type, finally the A-color LED lights and the B-color LED lights respectively flash in turn in the opposite direction; a sixth small mode: the A-color LED lights become dim gradually and then become bright gradually; a seventh small mode: A-color LED lights flash in turn;

as pressing the control button at fifth time: the LED light string is turned on in a fifth mode, i.e., the B-color LED lights illuminate in six automatic cycle modes including a first small mode: the B-color LED lights illuminate; a second small mode: the B-color LED lights illuminate in the wave type; a third small mode: the B-color LED lights illuminate in the water drop type; a fourth small mode: the B-color LED lights and the B-color LED lights illuminate in a step-by-step changing type, for instance, when the B-color LED lights illuminate in a bright-to-dim type, the B-color LED lights illuminate in a dim-to-bright type or when the B-color LED lights illuminate in the bright-to-dim type, the B-color LED lights illuminate in the dim-to-bright type; a fifth small mode: the B-color LED lights illuminate to one direction in the wave type, and then the B-color LED lights and the A-color LED lights respectively flash in turn, thereafter the B-color LED lights illuminate to an opposite direction in the wave type, finally the B-color LED lights and the A-color LED lights respectively flash in turn in the opposite direction; a sixth small mode: the B-color LED lights become dim gradually and then become bright gradually; a seventh small mode: B-color LED lights flash in turn;

as pressing the control button at sixth time: LED light string illuminates in the sixth small mode and automatically cycles from the first small mode to the fifth small mode;

as pressing the control button at seventh time: the LED light string illuminates in the first small mode. i.e., the six LED light sets illuminate circularly. Besides, pressing the control button at the first time means pressing the switch and then pressing the control button.

While we have shown and described various embodiments in accordance with the present invention, it is clear to those skilled in the art that further embodiments may be made without departing from the scope of the present invention.

What is claimed is:

1. A LED light string comprising:

an adjustable remote control and a control host connected with the LED light string, characterized in that:

the adjustable remote control includes a button set, a sub-host MCU, and a TX transmitter module, the sub host includes a TX coding module for saving predetermined transmitting codes, and a variation of a pressed time and/or a pressing way of the button set generates a press signal received and coded by the TX coding module, and then a control signal is transmitted to the control host by the TX transmitter module to correspond to the press signal;

the control host includes a RX receiver module and a host MCU connected with the RX receiver module, the RX receiver module receives the control signal transmitted by the TX transmitter module and then transmits the control signal to the host MCU;

the host MCU includes an AC 60 HZ/50 HZ synchronization over-zero module, a RF decoding analysis module, and a two-way controllable silicon driving circuit module;

the AC 60 HZ/50 HZ synchronization over-zero module is used to acquire a 60 HZ/50 HZ signal in an alternating current to control a conductive phase angle of a silicon controlled rectifier such that the LED light string flashes in a light on-off and increasing-decreasing manner;

the RF decoding analysis module analyzes different control signals and outputs a flash signal corresponding to the different control signals to drive the silicon controlled rectifier;

the two-way controllable silicon driving circuit module connects with the LED light string and changes a conductive phase angle of a two-way silicon controlled rectifier by using a software coding method and a conduction current and changes a phase angle of a positive half-cycle and a negative half-cycle of the LED light string, thus controlling a light flash of the LED light string.

2. The LED light string as claimed in claim 1, wherein the adjustable remote control and the control host are connected in a wireless connection manner.

3. The LED light string as claimed in claim 1, wherein the LED light string is comprised of at least two LED light sets, and each LED light set has at least two different colors of LED lights.

4. The LED light string as claimed in claim 3, wherein the button set includes a control button and a switch, the control button is severed to realize six light flashes on the basis of different pressed times, the RF decoding analysis module analyzes the control signal transmitted from the adjustable remote control, the two-way controllable silicon driving circuit module changes the conductive phase angle of the two-way silicon controlled rectifier, a conduction current of the LED light string, a phase angle of a positive half-cycle and a negative half-cycle of the LED light string based on the flash signal, thus controlling a light flash of the LED light string.

5. The LED light string as claimed in claim 4, wherein the pressed time of the control button is seven to generate six light flashes containing:

as pressing the control button at first time: the LED light string is turned on in a first mode, i.e., starting the A-color LED lights;

as pressing the control button at second time: the LED light string is turned on in a second mode, i.e., starting the B-color LED lights;

as pressing the control button at third time: the LED light string is turned on in a third mode, i.e., the A-color LED lights flash to correspond to the B-color LED lights which flash;

as pressing the control button at fifth time: the LED light string is turned on in a fourth mode, i.e., the A-color LED lights illuminate in six automatic cycle modes including a first small mode: the A-color LED lights illuminate; a second small mode: the A-color LED lights illuminate in a wave type; a third small mode: the A-color LED lights illuminate in a water drop type; a fourth small mode: the A-color LED lights and the B-color LED lights illuminate in a step-by-step changing type, for instance, when the A-color LED lights illuminate in a bright-to-dim type, the B-color LED lights illuminate in a dim-to-bright type or when the B-color LED lights illuminate in the bright-to-dim type, the A-color LED lights illuminate in the dim-to-bright type; a fifth small mode: the A-color LED lights illuminate to one direction in the wave type, and then the A-color LED lights and the B-color LED lights respectively flash in turn, thereafter the A-color LED lights illuminate to an opposite direction in the wave type, finally the A-color LED lights and the B-color LED lights respectively flash in turn in the opposite direction; a sixth small mode: the A-color LED lights become dim gradually and then become bright gradually; a seventh small mode: A-color LED lights flash in turn;

as pressing the control button at fifth time: the LED light string is turned on in a fifth mode, i.e., the B-color LED lights illuminate in six automatic cycle modes including a first small mode: the B-color LED lights illuminate; a second small mode: the B-color LED lights illuminate in a wave type; a third small mode: the B-color LED lights illuminate in the water drop type; a fourth small mode: the B-color LED lights and the B-color LED lights illuminate in a step-by-step changing type, for instance, when the B-color LED lights illuminate in a bright-to-dim type, the B-color LED lights illuminate in a dim-to-bright type or when the B-color LED lights illuminate in the bright-to-dim type, the B-color LED lights illuminate in the dim-to-bright type; a fifth small mode: the B-color LED lights illuminate to one direction in the wave type, and then the B-color LED lights and the A-color LED lights respectively flash in turn, thereafter the B-color LED lights illuminate to an opposite direction in the wave type, finally the B-color LED lights and the A-color LED lights respectively flash in turn in the opposite direction; a sixth small mode: the B-color LED lights become dim gradually and then become bright gradually; a seventh small mode: B-color LED lights flash in turn;

as pressing the control button at sixth time: LED light string illuminates in the sixth small mode and automatically cycles from the first small mode to the fifth small mode;

as pressing the control button at seventh time: the LED light string illuminates in the first small mode. i.e., the six LED light sets illuminate circularly. Besides, pressing the control button at the first time means pressing the switch and then pressing the control button.

6. The LED light string as claimed in claim 4, wherein a carrier frequency point of the adjustable remote control is 433 MHz.

7. The LED light string as claimed in claim 4, wherein the transmitter module contains a TX transmitting circuit connected with a transmitting antenna.

8. The LED light string as claimed in claim 1, wherein the adjustable remote control and the control host include a step-down circuit, a rectifier circuit, a filter circuit, and a regulator circuit.

9. A control method of the LED light string as claimed in claim 1 comprises steps of:

S100 including receiving a button signal from a control button by using a TX coding module of an adjustable remote control, transmitting a control signal to a control host after the control signal is coed;

S200 including controlling a RX receiver module of the adjustable remote control to receive the control signal transmitted and then transmitting the control signal to the host MCU;

S300 including acquiring a 60 HZ/50 HZ signal in an alternating current by using an AC 60 HZ/50 HZ synchronization over-zero module of a host MCU to control a conductive phase angle of a silicon controlled rectifier; analyzing the control signal by ways of a RF decoding analysis module and outputting a flash signal to drive the silicon controlled rectifier; connecting a two-way controllable silicon driving circuit module with the LED light string, and changing a conductive phase angle of the two-way silicon controlled rectifier by using a software coding method and a conduction current and changing a phase angle of a positive half-cycle and a negative half-cycle of the LED light string, thus controlling a light flash of the LED light string;

S400 changing a pressed time of the control button so that the control signal is transmitted to the control host by the TX transmitter module to correspond to a press signal, wherein the control button is pressed one time to correspond to the control signal, and the control button is pressed twice to correspond to the control signal, and so no. The RF decoding analysis module analyzes different control signals and outputs a flash signal corresponding to the different control signals to drive the silicon controlled rectifier, thus controlling and shifting a light flash of the LED light string.

10. The LED light string as claimed in claim 9, wherein the pressed time of the control button is seven to generate six light flashes containing:

as pressing the control button at first time: the LED light string is turned on in a first mode, i.e., starting the A-color LED lights;

as pressing the control button at second time: the LED light string is turned on in a second mode, i.e., starting the B-color LED lights;

as pressing the control button at third time: the LED light string is turned on in a third mode, i.e., the A-color LED lights flash to correspond to the B-color LED lights which flash;

as pressing the control button at fifth time: the LED light string is turned on in a fourth mode, i.e., the A-color LED lights illuminate in six automatic cycle modes including a first small mode: the A-color LED lights illuminate; a second small mode: the A-color LED lights illuminate in a wave type; a third small mode: the A-color LED lights illuminate in a water drop type; a fourth small mode: the A-color LED lights and the B-color LED lights illuminate in a step-by-step changing type, for instance, when the A-color LED lights illuminate in a bright-to-dim type, the B-color LED lights illuminate in a dim-to-bright type or when the B-color LED lights illuminate in the bright-to-dim type, the A-color LED lights illuminate in the dim-to-bright type; a fifth small mode: the A-color LED lights illuminate to one direction in the wave type, and then the A-color LED lights and the B-color LED lights respectively flash in turn, thereafter the A-color LED lights illuminate to an opposite direction in the wave type, finally the A-color LED lights and the B-color LED lights respectively flash in turn in the opposite direction; a sixth small mode: the A-color LED lights become dim gradually and then become bright gradually; a seventh small mode: A-color LED lights flash in turn;

as pressing the control button at fifth time: the LED light string is turned on in a fifth mode, i.e., the B-color LED lights illuminate in six automatic cycle modes including a first small mode: the B-color LED lights illuminate; a second small mode: the B-color LED lights illuminate in a wave type; a third small mode: the B-color LED lights illuminate in the water drop type; a fourth small mode: the B-color LED lights and the B-color LED lights illuminate in a step-by-step changing type, for instance, when the B-color LED lights illuminate in a bright-to-dim type, the B-color LED lights illuminate in a dim-to-bright type or when the B-color LED lights illuminate in the bright-to-dim type, the B-color LED lights illuminate in the dim-to-bright type; a fifth small mode: the B-color LED lights illuminate to one direction in the wave type, and then the B-color LED lights and the A-color LED lights respectively flash in turn, thereafter the B-color LED lights illuminate to an opposite direction in the wave type, finally the B-color LED lights and the A-color LED lights respectively flash in turn in the opposite direction; a sixth small mode: the B-color LED lights become dim gradually and then become bright gradually; a seventh small mode: B-color LED lights flash in turn;

as pressing the control button at sixth time: LED light string illuminates in the sixth small mode and automatically cycles from the first small mode to the fifth small mode;

as pressing the control button at seventh time: the LED light string illuminates in the first small mode. i.e., the six LED light sets illuminate circularly. Besides, pressing the control button at the first time means pressing the switch and then pressing the control button.

* * * * *